US005934034A

United States Patent [19]

Yahiro et al.

[11] Patent Number: 5,934,034

[45] Date of Patent: Aug. 10, 1999

[54] FOUNDATION MATERIAL FOR USE WITH PUTTY AND MANUFACTURING METHOD THEREFOR

[75] Inventors: Nobuyuki Yahiro, Tokyo; Sonoe Nakagawa, Fukui; Shinichiro Kawase, Fukui; Shiro Sato, Fukui; Kiyoshi Akita, Fukui; Kazuhiko Kise, Tokyo, all of Japan

[73] Assignee: Fukuvi Chemical Industry Co., Ltd., Fukui-Ken, Japan

[21] Appl. No.: 08/876,984

[22] Filed: Jun. 16, 1997

[30] Foreign Application Priority Data

Nov. 15, 1996 [JP] Japan ..... 8-305390

[51] Int. Cl.[6] ..... E04F 19/02

[52] U.S. Cl. ..... 52/287.1; 52/288.1; 52/417; 52/255

[58] Field of Search ..... 52/287.1, 288.1, 52/416, 417, 255

[56] References Cited

U.S. PATENT DOCUMENTS

| | | | |
|---|---|---|---|
| 4,719,732 | 1/1988 | Bernard . | |
| 4,835,925 | 6/1989 | Hoffmann, Sr. . | |
| 4,977,718 | 12/1990 | Hoffmann, Sr. . | |
| 5,048,247 | 9/1991 | Weldy | 52/255 |
| 5,131,198 | 7/1992 | Ritchie et al. | 52/287 |
| 5,442,886 | 8/1995 | Iacobelli | 52/255 |
| 5,505,032 | 4/1996 | Wasserman et al. | 52/287.1 |
| 5,544,463 | 8/1996 | Bergin | 52/254 |
| 5,752,353 | 5/1998 | Koenig et al. | 52/255 |

FOREIGN PATENT DOCUMENTS 610465 2/1994 Japan .

*Primary Examiner*—Christopher Kent
*Assistant Examiner*—Yvonne Horton-Richardson
*Attorney, Agent, or Firm*—Jacox, Meckstroth & Jenkins

[57] ABSTRACT

This foundation material 1 comprises a substrate 2 having a sheet form, and a surface modifying layer on at least front surface of said substrate comprising 2~30 parts by weight of a film formation aiding agent for every 100 parts by weight of a resin having a hydrophilic functional group. In addition, this foundation material 1 is manufactured by forming substrate 2 by extrusion molding a synthetic resin, laminating at least a front surface of substrate 2 with a surface modifying agent comprising 2~30 parts by weight of a film formation aiding agent for every 100 parts by weight of a resin having a hydrophilic functional group, and drying the thus formed laminated substrate.

12 Claims, 5 Drawing Sheets

FOUNDATION MATERIAL FOR USE WITH PUTTY AND MANUFACTURING METHOD THEREFOR

BACKGROUND OF THE INVENTION

1. Field of the Invention

The present invention relates to a foundation material for use with putty which has superior adhesiveness and which can be easily and inexpensively manufactured, and to a manufacturing method therefor.

2. Description of the Related Art

When applying putty to the surface of indoor walls, ceilings, etc., in order to smoothly finish comers formed by walls and by walls and ceilings, a method is used in which the corner sections are covered by means of a foundation material which has been molded into a sheet from a synthetic resin, and the putty is applied to the surface thereof.

However, since putty is a mixture of inorganic material, such as minerals, and water soluble adhesive, the adhesiveness of the putty for a foundation material manufactured from resin is low, and the putty peels off easily from the surface of the foundation material. In order to increase the adhesiveness for putty, paper is adhered to the surface of the foundation material in advance. However, this type of foundation material has the problems that production costs are high and production efficiency is low because of the need for an adhesion step for the paper. In addition, after applying the putty, there are occasions when the paper peels away form the foundation material.

In light of the above-mentioned situation, an object of the present invention is the provision of a foundation material which is superior in adhesiveness for putty and which can be easily and inexpensively produced.

SUMMARY OF THE INVENTION

The present invention comprises a foundation material which can be arranged on walls of buildings, and putty applied to the surface thereof. This foundation material comprises, a substrate that has a sheet form, and, on at least front surface of the above-mentioned substrate, a surface modifying layer which contains 2~30 parts by weight of a film formation aiding agent for every 100 parts by weight of a resin which has a hydrophilic functional group. In the following, the surface of the substrate which is toward the wall of the building when arranged on the wall is called the back surface, and the surface of the wall which is away from the wall when arranged on the wall and to which putty is applied is called the front surface.

The thickness of the above-mentioned surface modifying layer is preferably 1~20 $\mu$m. In addition, in the above-mentioned foundation material, a plurality of apertures can be formed which gradually increase in diameter or incline from the front surface toward the back surface.

On the other hand, the above-mentioned substrate can be formed by means of unitarily molding sheet portions which can be respectively attached to the above-mentioned wall surfaces with a corner of the above-mentioned walls forming a boundary, and a plastically deformable hinge which joins these sheet portions to each other and runs along the above-mentioned corner.

In this situation, it is preferable for the proportion of plasticizing agent contained in the above-mentioned hinge to be 10~35% by weight. In addition, a predetermined angle can be formed in the above-mentioned hinge in advance.

The present invention also relates to a manufacturing method for the above-mentioned foundation material and, in particular, the formation of a surface modifying layer, based on a surface modifying agent, on at least the surface of the above-mentioned substrate. This surface modifying layer is formed by means of forming a substrate by extrusion molding a synthetic resin; laminating at least a front surface of this substrate with the above-mentioned surface modifying agent which contains 2~30 parts by weight of a film formation aiding agent for every 100 parts by weight of a resin having hydrophilic functional groups, and then drying.

Furthermore, the thickness of the above-mentioned surface modifying layer is preferably 1~20 $\mu$m, moreover, in order to make the thickness of the above-mentioned surface modifying layer uniform, it is preferable for the viscosity range of the above-mentioned surface modifying agent to be 10~3000 cp. In addition, for the same reason, it is preferable for the solid portion within the above-mentioned surface modifying agent to be 5~40% by weight. In addition, a plurality of apertures which gradually increase in diameter or incline from the front surface of the substrate toward the back surface of the substrate can be formed in the above-mentioned substrate, and then lamination with the above-mentioned surface modifying agent may be conducted.

BEST MODE FOR CARRYING OUT THE INVENTION

Figure 1:
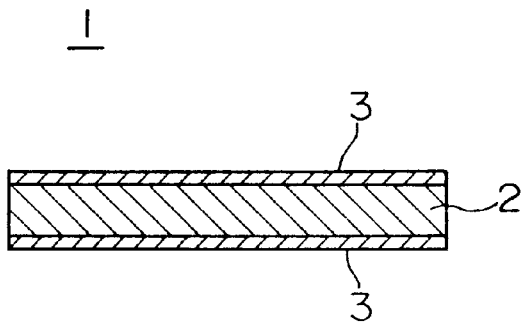
FIG. 1 is a cross-section showing an example of the structure of the foundation material of the present invention.

An example of the structure of the foundation material according to the present invention is shown in FIG. 1. In the Figure, 1 is the foundation material and this foundation material comprises, for example, a substrate 2 formed by molding a synthetic resin such as polyvinyl chloride into a sheet, and a surface modifying layer 3 laminated onto each of the front surface and back surface of the substrate 2.

The surface modifying layer 3 contains 2~30 parts by weight of a film formation aiding agent for every 100 parts by weight of a resin having a hydrophilic functional group. When the amount of film formation aiding agent contained is less than 2 parts by weight, the adhesiveness of the surface modifying layer 3 with regard to the foundation material and the putty is reduced. On the other hand, when the amount of film formation aiding agent contained exceeds 30 parts by weight, the drying solidification which occurs when laminating surface modifying layer 3 is hindered.

In addition, examples of the above-mentioned resin having a hydrophilic functional group include modified urethane, modified polyamide, polyester, acrylic, vinyl acetate, and the like. As the film formation aiding agent, known film formation aiding agents can be used, for example, 1-methyl 2-pyrrolidone, dimethylformarnide, ethylene glycol monoethylether, diethylene glycol monoethylether, diethylene glycol monobutylether, diethlyeneglycol monoethyletheracetate, and the like can be mentioned.

Furthermore, the thickness of the surface modifying layer 3 is 1~20 μm and preferably 5–20 μm. When the thickness of the surface modifying layer 3 is less than 1 μm, the adhesiveness for the putty is reduced, on the other hand, when the thickness of the surface modifying layer 3 exceeds 20 μm, there is the likelihood that the substrate 2 and the surface modifying layer 3 will separate from each other.

Figure 2:
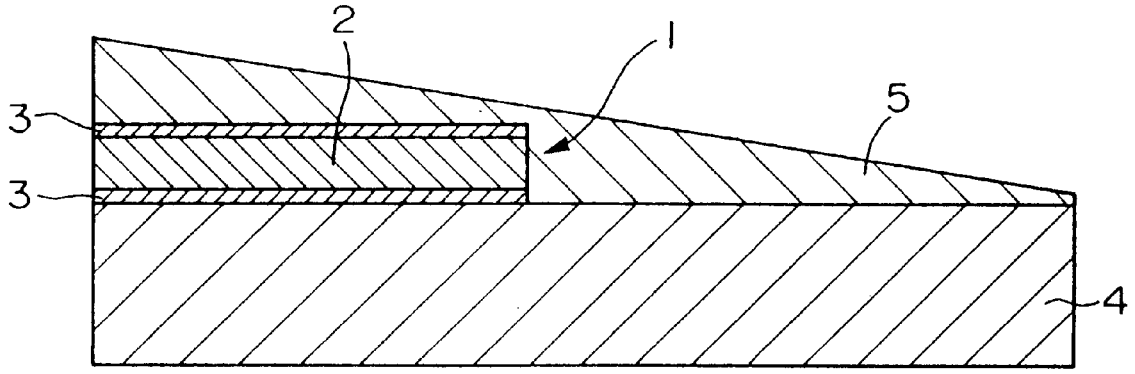
FIG. 2 is a cross-section showing an example of the foundation material of the present invention in use with putty.

The application of putty using a foundation material having the above-mentioned structure is exactly the same as when using a conventional foundation material. That is to say, as shown in FIG. 2, foundation material 1 is affixed to wall 4 using an adhesive or the like, putty 5 is applied to the front surface side of that foundation material, and then finished. As a result, the surface of wall 4 is covered by foundation material 1, and a smooth finished surface is obtained. Furthermore, due to the action of the film formation aiding agent which is added to the surface modifying layer 3, the surface modifying layer 3 has high adhesiveness with regard to both the foundation material 1 and the putty 5, and thereby peeling of the putty 5 from the surface of foundation material 1 and peeling of the surface modifying layer 3 from substrate 2 is prevented.

Figure 3:
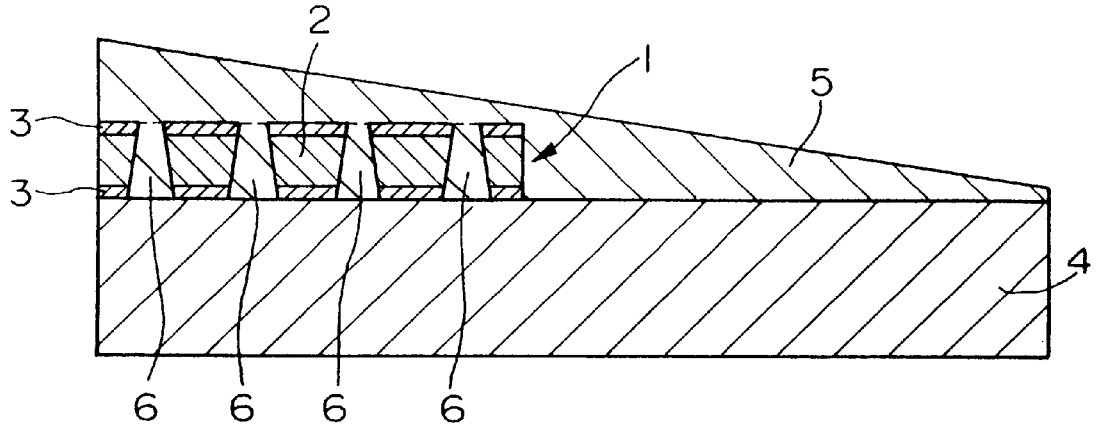
FIG. 3 is a cross-section showing an example of the foundation material of the present invention in use with putty.
Figure 4:
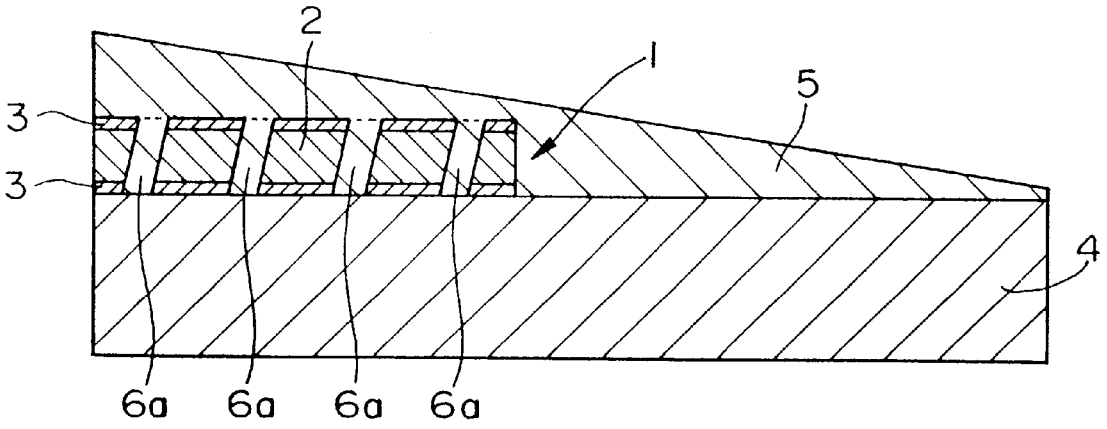
FIG. 4 is a cross-section showing an example of the foundation material of the present invention in use with putty.

As shown in FIG. 3 and FIG. 4, in foundation material 1, it is possible to form a plurality of apertures 6 which gradually increase in diameter from the front surface of the foundation material 1 toward the back surface of the foundation material 1. It is also possible to form a plurality apertures 6*a* which are inclined from the front surface of the foundation material 1 toward the back surface of the foundation material 1. In these cases, due to the physical anchoring effects which act between the putty 5, which fills the apertures 6 and 6*a* after application, and the inner peripheral surface of apertures 6 and 6*a*, the effects which prevent peeling of the putty 5 are further increased.

Furthermore, the size or the shape of the apertures 6 and 6*a* can be varied with the predetermined distance; in addition, sections without apertures 6 and 6*a* can be provided at regular distance. In this situation, because the variation in the apertures 6 and 6*a* and the unformed sections function as a measure along the length of the foundation material 1, it is possible to cut foundation material 1 to the desired length without using a tape measure, ruler or the like.

Figure 5:
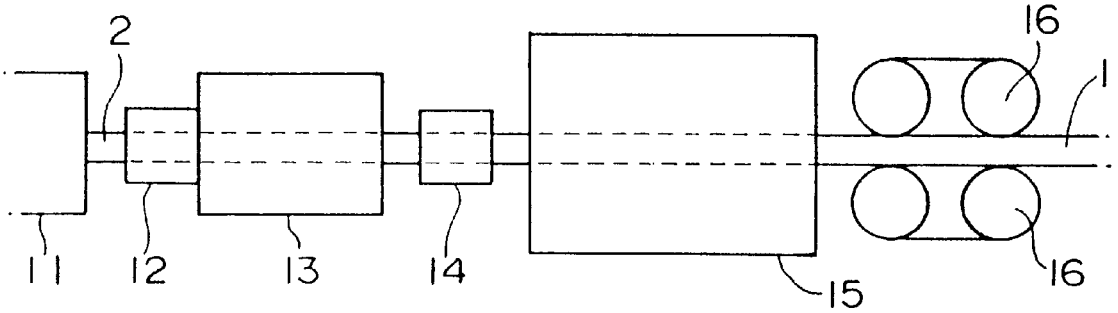
FIG. 5 is a diagram showing an example of a production line for the foundation material of the present invention.

Next, in the following the manufacturing method for the above-mentioned foundation material is explained. An example of a production line for the foundation material 1 is shown in FIG. 5. Substrate 2 which is extrusion molded by means of mold 11 is formed into a predetermined shape by means of sizing die 12 while being transported along in a longitudinal direction (to the right in the figure) of the substrate 2. The formed substrate 2 is cooled in cooling tank 13 and surface modifying agent is applied to the front surface and back surface of substrate 2 by means of coating machine 14.

This surface modifying agent is a solution of the above-mentioned resin having a hydrophilic functional group and film formation aiding agent in a solvent, and the mixing ratio is, with regard to 100 parts by weight of resin, 2~30 parts by weight of film formation aiding agent and 150~1900 parts by weight of solvent. In addition, the range of the viscosity of the surface modifying agent is 10~3000 cp and preferable 10~2000 cp. Moreover, the solid portion within the surface modifying agent is 5~40% by weight, and preferably 10~35% by weight.

The reason why the viscosity of the surface modifying agent is 10 cp or greater and the solid portion is 5% by weight or greater is that when the viscosity of the surface modifying agent is less than 10 cp, or the solid portion is less than 5% by weight, the viscosity of the surface modifying agent is reduced, and it is not possible to maintain the thickness of the surface modifying layer 3 which is formed by drying the surface modifying agent at 1 mm or greater. On the other hand, the reason why the viscosity of the surface modifying agent is 3000 cp or less than and the solid portion within the surface modifying agent is 40% by weight or less is that when the viscosity of the surface modifying agent exceeds 3000 cp and the solid portion within the surface modifying agent exceeds 40% by weight, the fluidity of the surface modifying agent is reduced and as a result the thickness of surface modifying layer exceeds 20 μm and the thickness of the surface modifying layer 3 is not uniform.

The substrate to which the surface modifying agent has been applied is next dried by means of drier 15 and as a result a foundation material 1 as shown in FIG. 1 is formed. In addition, the foundation material 1 is transported by the roller 16. Alternatively, as shown in FIG. 3 and FIG. 4, when manufacturing a foundation material 1 having apertures 6 and 6*a*, after cooling, a plurality of apertures 6 and 6*a* can be formed in a predetermined formation in substrate 2 and then lamination of the substrate with surface modifying agent can be conducted.

By means of a manufacturing method for a foundation material 1 like that mentioned above, a substrate 2 which has been extrusion molded in a mold 11 can be manufactured into a foundation material 1 easily and without interruption on the same production line. As a result, compared with conventional foundation materials which require troublesome processes such as paper adhesion processes, and the like, the foundation material of the present invention has high production efficiency and reduced production costs. In other words, by means of the present invention, it is possible to easily and inexpensively provide a foundation material 1 comprising a surface modifying layer 3 having high adhesiveness with regard to both the substrate 2 and the putty 5.

Moreover, when applying the surface modifying agent to the substrate 2 in the coating machine 14, known methods can be used, for example, methods in which the substrate 2 is immersed in the surface modifying agent, methods in which the surface modifying agent is sprayed onto substrate 2, and the like can be mentioned. In addition, it is not always necessary for the surface modifying layer 3 to be laminated onto both the front and back surface of the foundation material 1 and by laminating at least the front surface of the foundation material 1, it is possible to prevent the putty 5 from peeling away from the surface of the foundation material 1.

Furthermore, the shape of the foundation material 1, that is, the shape of the substrate 2, can be optionally set so as to correspond to the shape of the wall section 4 to which the foundation material 1 is to be affixed.

Figure 6:
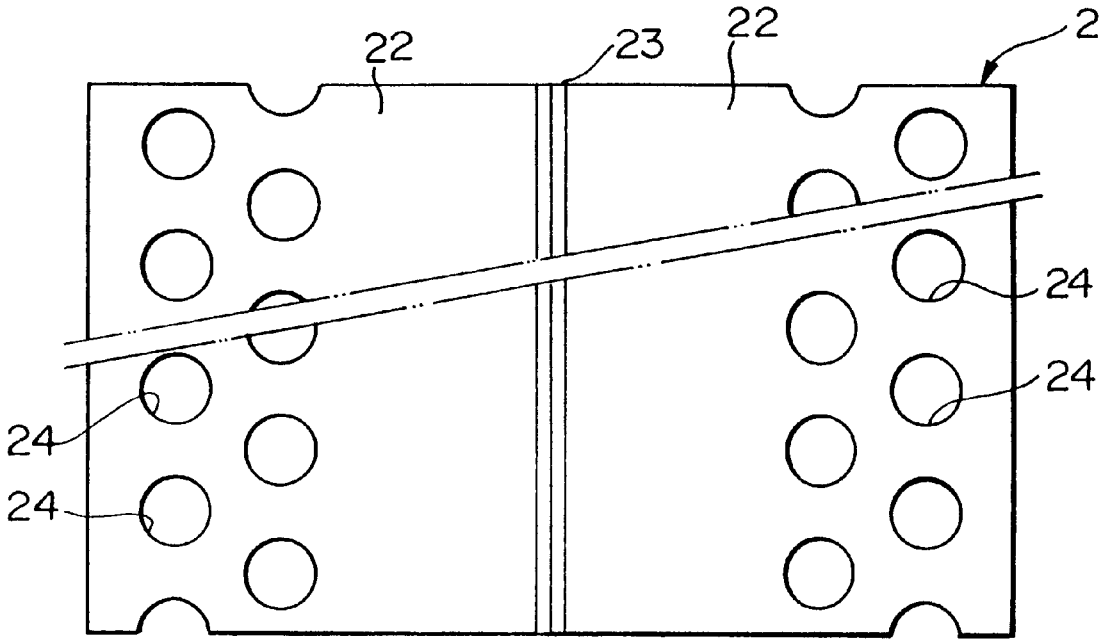
FIG. 6 is a plane diagram showing an example of the shape of the substrate used in the foundation material of the present invention.
Figure 7:
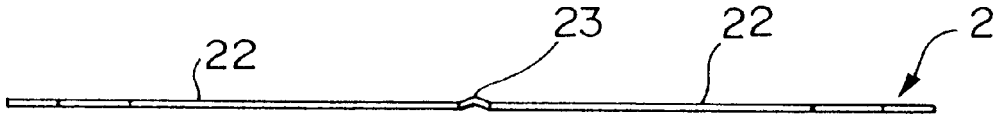
FIG. 7 is a cross-section showing an example of the shape of the substrate used in the foundation material of the present invention.
Figure 8:
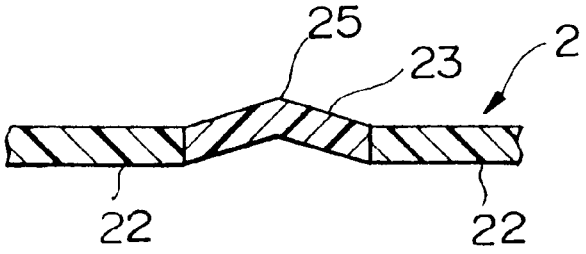
FIG. 8 is a cross-section of the hinge section and neighboring sections showing an example of the shape of the hinge section of the substrate used in the foundation material of the present invention.

FIG. 6 and FIG. 7 show a substrate 2 which comprises sheet sections 22 and a hinge section 23 between these sheet sections 22, and this substrate 2 is unitarily molded by means of extrusion molding. A plurality of apertures 24 are formed in the longitudinal direction in the vicinity of the edges of sheet sections 22. In addition, the central section 25 of the hinge section 23 has been bent in advance into a broad inverted V shape as shown in FIG. 8.

Figure 9:
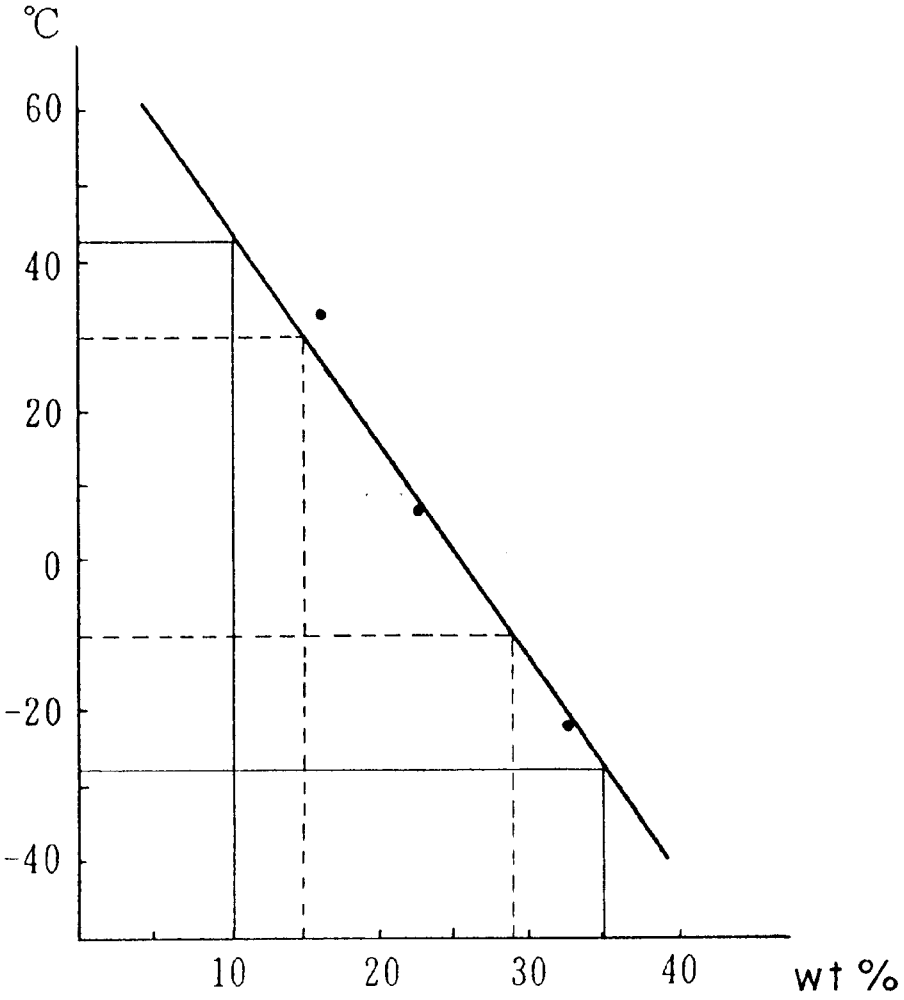
FIG. 9 is a graph which explains the content of the plasticizing agent in the hinge portion of the substrate used in the foundation material of the present invention.

The hinge section of this substrate 2 has been molded to a stiffness which can be plastically deformed, as a result, when the hinge section 23 is bent, that bent condition is maintained. The content of the plasticizing agent in the synthetic resin for the hinge section 23 is 10~35% by weight when using, for example, dioctylphthalic acid (DOP) as a plasticizing agent, as shown in FIG. 9. More specifically, when the amount of plasticizing agent is within this range, the performance of the plastic deformability of hinge section 23 is certain and the hinge section 23 will maintain its bent condition at a temperature range of −10~+30° C. which is a normal temperature range for building construction sites.

In contrast, in the above-mentioned example, when the content of the plasticizing agent is less than 10% by weight, the hinge section 23 breaks when the working temperature is low. On the other hand, when the content of the plasticizing agent exceeds 35% by weight, the problem arises that at high working temperatures, the workability of the plastic deformability of the hinge section 23 becomes inferior.

In addition, plasticizing agents other than dioctylphthalic acid which can be used include, for example, dibutylphthalic acid (DBP), diethylphthalic acid (DEP), dicaprylphthalic acid (DCP), diisodecylphthalic acid (DIDP), dinonylphthalic acid (DNP), octyldecylphthalic acid (ODP), butylbenzylphthalic acid (BBP), butylphthalylbutylglycolate (BPBG), butylaurylphthalic acid (BLP), and the like.

Figure 10:
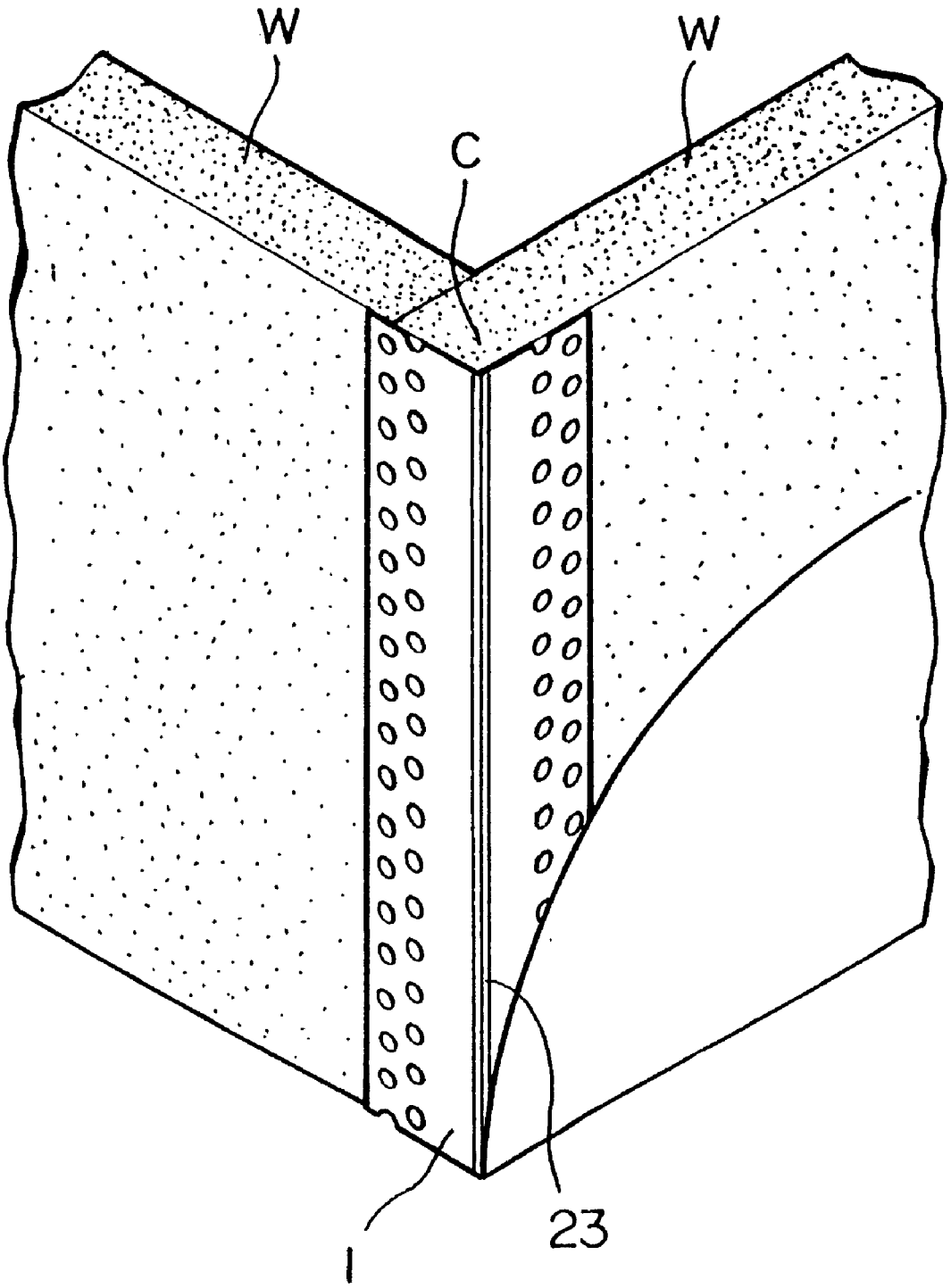
FIG. 10 is a perspective view of a wall section on which the substrate material has been installed for explaining the manner of installation of the substrate material of the present invention.

By means of this foundation material 1, as shown in FIG. 10, the hinge section 23 is bent so as to fit the angle of the corner C of the wall W and each of the sheet sections 22 are brought into contact with the surface of the wall so that the back surface of the sheet sections 22 adhere to the surface of the wall, thereby the foundation material 1 can be extremely easily attached to the corner section C in such a way as to match the angle of the corner section C.

In particular, by means of the above-mentioned foundation material 1, when the hinge section 23 is bent so as to fit the angle of corner section C, hinge section 23 is plastically deformed, therefore, the sheet sections 22 are able to maintain the condition in which they are arranged along the respective surfaces of the wall. As a result, troublesome operations like maintaining the folded shape of the foundation material 1 until the surface modifying material solidifies are unnecessary and effects such as greatly improved working efficiency and reduced working time can be obtained.

Moreover, since an angle has been set in the center portion 25 of the hinge section 23 in advance, when attaching the foundation material 1 to the comer section C, it is possible to obtain a sharp angle by matching the angle of the corner of the corner section C, and as a result, it is possible to obtain an improved external appearance.

Moreover, in the above-mentioned example, as an example, the foundation material has been fitted to the corner section C of the outer corner section of wall W so as to explain the present invention; however, this foundation material can also be fitted to the corner section of inner corner section of wall W. In this situation, the same results can be achieved.

Embodiments

In the following, embodiments of the present invention are shown and their effects explained.

1. Test of the Adhesiveness Between the Substrate and the Surface Modifying Layer Test Sheet: Test sheets were prepared by uniformly applying surface modifying agents having the compositions shown below to the surface of polyvinyl chloride sheets having a size of 100 mm×100 mm and a thickness of 1 mm and then allowing them to dry.

Embodiment 1

100 parts by weight of modified urethane and 15 parts by weight of 1-methyl 2-pyrrolidone were dissolved in 400 parts by weight of solvent.

Embodiment 2

100 parts by weight of modified urethane and 15 parts by weight of dimethylformamide were dissolved in 400 parts by weight of solvent.

Embodiment 3

100 parts by weight of modified polyamide and 3 parts by weight of 1-methyl 2-pyrrolidone were dissolved in 400 parts by weight of solvent.

Comparative Example 1

100 parts by weight of modified urethane were dissolved in 400 parts by weight of solvent.

Comparative Example 2

100 parts by weight of modified urethane and 0.5 parts by weight of 1-methyl 2-pyrrolidone were dissolved in 400 parts by weight of solvent.

Comparative Example 3

100 parts by weight of modified urethane and 3 parts by weight of 1-methyl 2-pyrrolidone were dissolved in 5000 parts by weight of solvent.

Test Method

For each of the above-mentioned test sheets, each of the following treatments were conducted, then, with reference to the Japanese Industrial Standard K5400-1990 (General Test Method for Paint), 8.5.2 (Grid and Tape Method), crossed 6 parallel lines were drawn each other at 3 mm intervals to form a grid on the surface modifying layer, with 25 grids being formed; adhesive tape was affixed to the surface of the surface modifying layer, the adhesive tape was then forcibly peeled off and adhesiveness was evaluated from the total peeling off of the surface modifying layer which occured due to the forced peeling off of the adhesive tape as indicated by observation of the grids.

Treatment 1: Left at room temperature for one week.

Treatment 2: Left at −10° C. for two hours and then left for 2 hours at +50° C., and repeated 10 times (heat cycle).

Test Results

The results of the evaluation of adhesiveness for each of the test sheets is shown in Table 1.

TABLE 1

| Test Sheet | Evaluation | |
|---|---|---|
| | Treatment 1 | Treatment 2 |
| Embodiment 1 | ○ | ○ |
| Embodiment 2 | ○ | ○ |
| Embodiment 3 | ○ | ○ |
| Comparative Example 1 | X | X |
| Comparative Example 2 | X | X |
| Comparative Example 3 | X | X |

Evaluation Marks:
○ No Peeling Off
X Total area of the peeled off section is 50% or greater of the total surface area of the grid From the above results, with regard to the adhesiveness between the substrate and the surface modifying agent, it is clear that the test sheets of the Embodiments have higher adhesiveness compared with all of the Comparative Examples.

2. Test of the Adhesiveness Between the Surface Modifying Layer and Putty

Test Sheet: In addition to each of the test sheets used in Test 1, as a new Comparative Example 4, a polyvinyl chloride sheet having a size of 100 mm×100 mm and a thickness of 1 mm was prepared. 100 parts by weight of a commercially available plaster powder-type putty to which 50~60 parts by weight of water had been added was kneaded and then applied at a thickness of 5 mm to the surface of each test sheet and allowed to dry, thereby, the test sheets were obtained.

Test Methods

Conducted in the same manner as Test 1.

Test Results

The evaluation results for adhesiveness for each of the test sheets are shown in Table 2.

TABLE 2

| Test Sheet | Evaluation | |
|---|---|---|
| | Treatment 1 | Treatment 2 |
| Embodiment 1 | ○ | ○ |
| Embodiment 2 | ○ | ○ |
| Embodiment 3 | ○ | ○ |
| Comparative Example 1 | X | X |
| Comparative Example 2 | X | X |
| Comparative Example 3 | X | X |
| Comparative Example 4 | X | X |

Evaluation Marks: As for Test 1

From the above results, with regard to the adhesiveness between the surface modifying layer and putty, as with Test 1, the test sheets of the Embodiments have higher adhesiveness compared with all of the Comparative Examples. In other words, the surface modifying layer used on the test sheets of the Embodiments have higher adhesiveness for both the foundation material and the putty compared with the Comparative Examples.

What is claimed is:

1. A foundation material which is arranged on a surface of a wall of a building and to a surface of which putty is applied, comprising a substrate having a sheet form;

a surface modifying layer to strengthen the adhesion of the foundation material to the putty containing 2–30 parts by weight of a film formation aiding agent for every 100 parts by weights of a resin having a hydrophilic functional group;

a plurality of individually formed apertures which gradually increase in diameter from a front surface toward a back surface of said foundation material.

2. A foundation material according to claim 1, wherein a thickness of said surface modifying layer is 1~20 μm.

3. A foundation material which is arranged on a surface of a wall of a building and to a surface of which putty is applied, comprising a substrate having a sheet form;

a surface modifying layer to strengthen the adhesion of the foundation material to the putty containing 2–30 parts by weight of a film formation aiding agent for every 100 parts by weights of a resin having a hydrophilic functional group;

a plurality of individually formed apertures which incline from a front surface toward a back surface of said foundation material.

4. A foundation material according to claim 3, wherein a thickness of said surface modifying layer is 1~20 μm.

5. A foundation material which is arranged on a surface of a wall of a building and to a surface of which putty is applied, comprising a substrate having a sheet form;

a surface modifying layer to strengthen the adhesion of the foundation material to the putty containing 2–30 parts by weight of a film formation aiding agent for every 100 parts by weights of a resin having a hydrophilic functional group;

a plurality of individually formed apertures which gradually increase in diameter from a front surface toward a back surface of said foundation material;

wherein said substrate is unitarily molded and comprises sheet sections which can be respectively attached to said wall surface with a corner section of said wall as a border; and a plastically deformable hinge section which connects said sheet sections and which runs along said corner section of said wall.

6. A foundation material according to claim 5 for use with a foundation adjusting material, wherein a thickness of said surface modifying layer is 1~20 μm.

7. A foundation material according to claim 5, wherein an amount of plasticizing agent contained in said hinge section is 10~35% by weight.

8. A foundation material according to claim 5, wherein an angle is pre-formed in said hinge section.

9. A foundation material which is arranged on a surface of a wall of a building and to a surface of which putty is applied, comprising a substrate having a sheet form;

a surface modifying layer to strengthen the adhesion of the foundation material to the putty containing 2–30 parts by weight of a film formation aiding agent for every 100 parts by weights of a resin having a hydrophilic functional group; and a plurality of individually formed apertures which incline from a front surface toward a back surface of said foundation material;

wherein said substrate is unitarily molded and comprises sheet sections which can be respectively attached to said wall surface with a corner section of said wall as a border; and a plastically deformable hinge section which connects said sheet sections and which runs along said corner section of said wall.

10. A foundation material according to claim 9 for use with a foundation adjusting material, wherein a thickness of said surface modifying layer is 1~20 $\mu$m.

11. A foundation material according to claim 9, wherein an amount of plasticizing agent contained in said hinge section is 10~35% by weight.

12. A foundation material according to claim 9, wherein an angle is pre-formed in said hinge section.

* * * * *